United States Patent [19]

Nelson

[11] Patent Number: 5,005,364

[45] Date of Patent: Apr. 9, 1991

[54] APPARATUS FOR AND METHOD OF MAKING AND DELIVERING SLUSH ICE

[76] Inventor: William R. Nelson, 1549 N.W. 49th Street, Seattle, Wash. 98107

[21] Appl. No.: 476,516

[22] Filed: Feb. 7, 1990

[51] Int. Cl.[5] ..... F25C 1/00

[52] U.S. Cl. ..... 62/76; 62/330; 366/165; 366/262; 366/295; 415/121.2

[58] Field of Search ..... 415/121.2, 143; 366/165, 262–266, 293, 295; 62/76, 330

[56] References Cited

U.S. PATENT DOCUMENTS

| | | | |
|---|---|---|---|
| 2,416,432 | 2/1947 | Brady | 241/60 |
| 2,602,303 | 7/1952 | McLain et al. | 62/1 |
| 3,004,395 | 10/1961 | Morris, Jr. | 62/66 |
| 3,004,407 | 10/1961 | Morris, Jr. | 62/374 |
| 3,250,086 | 5/1966 | Morris, Jr. | 62/375 |
| 3,319,436 | 5/1967 | Wilch | 62/68 |
| 4,095,286 | 6/1978 | Ellis | 366/293 |
| 4,249,388 | 2/1981 | Burns | 62/185 |
| 4,287,725 | 9/1981 | Hoenisch | 62/344 |
| 4,401,449 | 8/1983 | Martin et al. | 62/340 |
| 4,456,424 | 6/1984 | Araoka | 415/121 |
| 4,646,526 | 3/1987 | Garland | 62/66 |
| 4,728,256 | 3/1988 | Araoka | 415/121 |
| 4,769,221 | 9/1988 | Marihart | 366/165 X |
| 4,796,441 | 1/1989 | Goldstein | 62/354 |
| 4,833,897 | 5/1989 | Burns | 62/330 |
| 4,845,954 | 7/1989 | Johansson | 62/66 |
| 4,848,097 | 7/1989 | Roberts | 417/44 X |

FOREIGN PATENT DOCUMENTS

| | | |
|---|---|---|
| 1208027 | 7/1986 | Canada . |
| 168537 | 1/1986 | European Pat. Off. . |

*Primary Examiner*—William E. Tapolcai
*Attorney, Agent, or Firm*—Glenn D. Bellamy

[57] ABSTRACT

An apparatus for and method of making and delivering slush ice includes providing a main housing (28) having a floor (30) and substantially cylindrical sidewalls (32). The housing (28) includes a water inlet (58) and an ice inlet (26). A pump (34) having a delivery outlet (50) is positioned to have an inlet (44) substantially centered axially within the housing (28) and spaced a predetermined distance from the floor (30). A delivery conduit (52) extends from the delivery outlet (50) of the pump (34) to a second end (72, 88) remote therefrom. A rotating agitator member (54, 54') having an axis of rotation substantially centered co-axially within the housing (28) is positioned such that the agitator (54, 54') swirls ice and water in the housing (28) substantially around the pump inlet (44). The pump (34) draws ice and water through the inlet (44) and delivers a mixture of ice and water in the form of slush ice (16) through the delivery outlet (50). Slush ice produced according to this method and by this apparatus is soft, noncaking, and free of irregular and sharp edges.

28 Claims, 5 Drawing Sheets

APPARATUS FOR AND METHOD OF MAKING AND DELIVERING SLUSH ICE

TECHNICAL FIELD

This invention relates to an apparatus for and method of making and delivering slush ice, and including slush ice made by such method. The apparatus is characterized by a receptacle into which ice pieces and water are delivered and agitated in a swirling motion for subsequent pumping and delivering as slush ice.

BACKGROUND ART

It is common practice to refrigerate fish, poultry and vegetables with ice for shipment or for storage while awaiting processing. Typically, chipped or flake ice is simply shoveled into cartons or containers on top of or along with the items to be chilled. Loading containers in this manner is labor intensive and requires constant attention to assure even and effective icing. Flake ice or chipped ice is hard, brittle, and inherently has sharp or jagged edges. These sharp edges can damage the food products as the contents of containers shift during shipment or simply under the weight of the goods and ice packed above lower items in the container. Because flake ice is relatively dry, it can be difficult to move from its point of production to point of use other than by cumbersome and expensive belt- or auger-type conveyors, or hand shovelling. Even so, flake ice is subject to clumping and caking after such ice pieces remain in contact with each other for even a relatively short period of time. Clumps of flake ice are even more likely to cause damage to chilled products as they are rubbed or packed together. Also, because flake ice and clumps of the same have irregular surface areas, the cooling effect of even super-cooled ice can be less than effective, or at least significantly diminished.

Prior art devices have been made which produce and deliver a mixture of ice and water in the form of a slurry or "liquid ice." Such devices are shown in U.S. Pat. Nos. 4,249,388 and 4,833,897. These patents disclose devices with complex agitation blades and baffles for pulverizing the ice pieces and maintaining an homogeneous mixture of ice and water. These devices draw ice and water to be pumped from the bottom of an agitation tank and require the agitation blades to drive the ice pieces, against their natural tendency to float, to this bottom portion of the tank.

A different approach for producing an ice slurry or slush is disclosed in U.S. Pat. Nos. 4,401,449 and 4,796,441. These patents disclose devices which freeze ice crystals in solution as water is subjected to increased pressure and/or decreased temperature. These systems rely on the water being maintained at a critical eutectic concentration (salinity) or pressure. Slight variations in these requirements can cause serious malfunctioning of the device.

Despite the availability of these prior art devices which create an ice slurry or slush ice, it has remained common, particularly in the fish industry, to use dry flake or chipped ice for refrigeration of fresh goods.

SUMMARY OF THE INVENTION

The present invention economically provides slush ice at consistent qualitY and in high volume without the drawbacks of previous devices.

The apparatus according to the present invention provides a main housing having a floor and substantially cylindrical sidewalls. The housing includes a water inlet and an ice inlet. A pump having a delivery outlet is positioned to have an inlet substantially centered axially within the housing and spaced a predetermined distance from the floor. A rotating agitator member having an axis of rotation substantially centered co-axially within the housing swirls ice and water in the housing substantially around the pump inlet. The pump draws ice and water through the inlet and delivers a mixture of the same in the form of slush ice through the delivery outlet.

The method of producing and delivering slush ice according to the present invention includes providing the above-described housing and pump and delivering ice pieces and water into the housing at a rate which maintains the level of water and ice pieces higher than the pump inlet. The ice pieces and water are swirled within the housing such that the ice pieces and water are agitated and admixed by the swirling. The agitated and admixed ice and water mixture is drawn int the pump inlet and delivered as slush ice through the pump outlet.

The slush ice produced according to this method has the unique characteristics of being smooth-flowing, non-clumping, and comprising smooth particles which distribute evenly around and efficiently cool the products to be chilled.

Other important aspects of the invention may include ozonation of the water in the slush ice to sterilize and deslime the products being chilled. Also, a unique water-removing cuff may be used for removal of some or all of the water carried with the slush ice at its point of delivery to return the water to the slush ice maker for re-use as a mixer or carrier.

Other important aspects and features of this invention will become apparent upon inspection of the various figures of the drawing, the following description of the preferred mode for carrying out the invention, and the appended claims.

BRIEF DESCRIPTION OF THE DRAWINGS

Like reference numerals are used to indicate like parts throughout the various figures of the drawing, wherein.

BEST MODE FOR CARRYING OUT THE INVENTION

Figure 1:
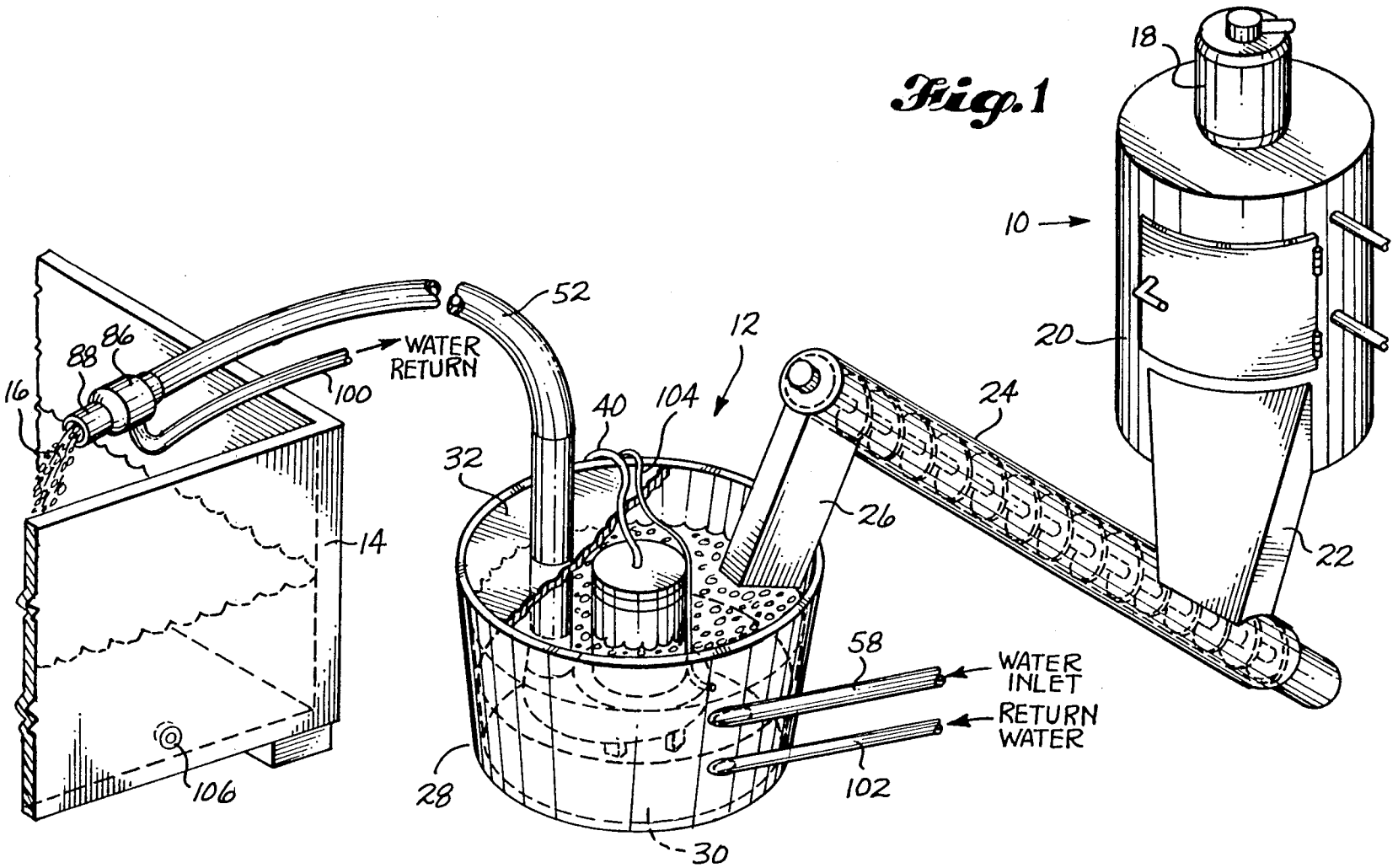
FIG. 1 is a pictorial view of the preferred embodiment of the apparatus of the present invention showing the production of flake ice, production and pumping of slush ice, and delivery of slush ice.

Referring to the several figures of the drawing, and first to FIG. 1, therein is shown generally a flake ice maker 10 of well-known and standard construction, a slush ice making/pumping apparatus 12 according to the preferred embodiment of the invention, and a container 14 into which slush ice 16 is being delivered. Raw ice may be supplied from any of a variety of sources. Flake ice is produced by spraying water onto the interior of a refrigerated drum where a layer of ice freezes and is subsequently chipped loose by a rotating rake or blade. Tube ice is produced by freezing water inside a refrigerated tube and then melting a thin outside layer of the ice to allow the hollow ice core to be continuously moved inside the tube. As the ice emerges from the end of the tube, it is broken off into pieces. Small cubes or broken sheets of ice may also be suitable as a source of raw ice for slush ice making.

In the illustrated embodiment, a typical flake ice making machine 10 is shown which includes a freezing drum 18 and a holding hopper 20. A chute 22 is provided which delivers ice from the hopper 20 into a auger-type conveyor 24. The auger conveyor 24 carries the ice to an inclined delivery chute 26 through which the ice pieces slide into a main housing 28 of the slush ice making apparatus 12. The illustrated embodiment of a raw ice producing and delivering means is shown for illustrative purposes only. Suitable ice may be produced by any of a number of available pieces of equipment and may be positioned so as to eliminate the need for mechanical conveyors of any type, depending upon the particular installation requirements.

Figure 2:
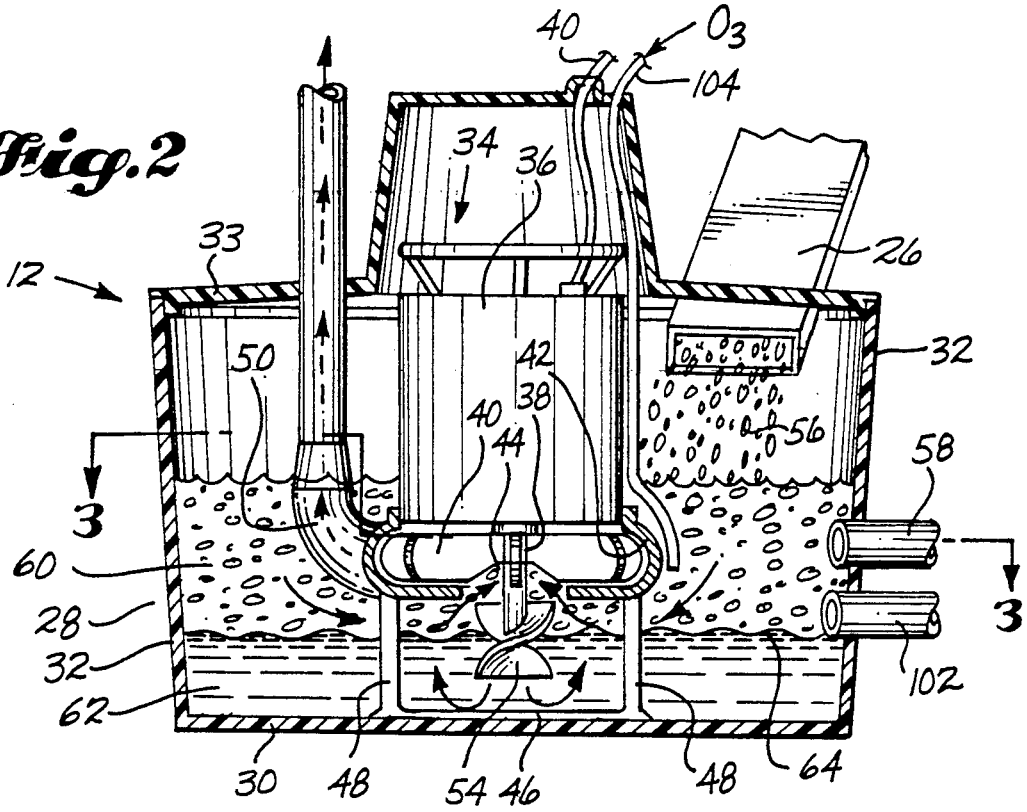
FIG. 2 is a cross-sectional view of the slush ice making and pumping apparatus.
Figure 3:
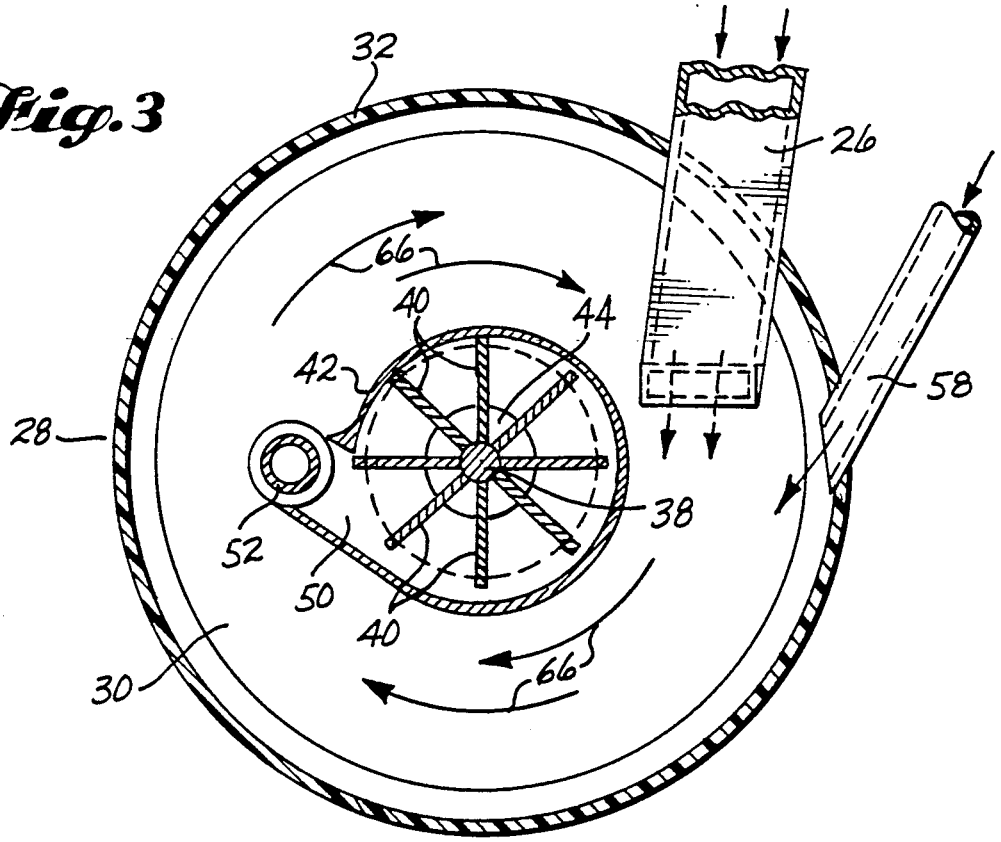
FIG. 3 is a cross-sectional view of the slush ice making and pumping apparatus taken substantially along line 3—3 of FIG. 2.

Referring now also to FIG. 2, the slush ice making-/delivering apparatus is shown at 12 according to the preferred embodiment of the invention. The apparatus includes a main housing 28 having a bottom wall 30 and substantially cylindrical sidewalls 32. The sidewalls 32 may be slightly inclined, as shown, if desired. The exact slope of the sidewalls 32 is not critical, however, it is desirable that the housing 28 present a substantially rounded interior in crosssection, as shown in FIG. 3, without sharp corners or pockets which would create turbulence or resistance to the circular flow of ice and water. The housing 28 may also include a lid 33 shaped as necessary to enclose any equipment positioned within the housing 28. A lid 33 is not critical to the operation of the apparatus 12, but may be desirable to insulate the interior of the housing 28 from external heat and/or contamination. Various apertures are formed in the housing 28 as necessary, the function of each of which will be described below.

Disposed at approximately the axial center of the housing 28 is a submersible, electric centrifugal pump and agitation means 34. The pump 34 includes a sealed motor housing 36 with an electric motor (not shown) having a downwardly-directed drive shaft 38 and being powered through cable 40. A multi-vane impeller 40 rotates within an impeller housing 42 which has a downwardly-directed inlet opening 44. The inlet opening 44 is held at a position spaced above the bottom wall 30 of the housing 28 by a support stand including a bottom plate 46 and a plurality of support legs 48. The impeller housing 42 includes a tangential discharge outlet 50 which provides an upwardly-directed delivery opening connectable to pipe or flexible tubing 52 of suitable corresponding diameter. Axially spaced from the impeller 40 and below the inlet opening 44 is an agitator member 54. In preferred form, the agitator member 54 is mounted on a common drive shaft 38 with the impeller 40 to be driven by a common motor. The specific construction and operation of the impeller 54 will be described in further detail below.

Agitator/pump combinations having some structural similarities to that described above and illustrated herewith are shown in U.S. Pat. Nos. 4,456,424 and 4,728,256. A submersible dredging and sand excavating pump which may be modified in accordance with the present invention is available from Toyo Pumps North America Corporation, a Japan corporation having U.S. offices in Chicago, Ill.

Other pump/agitator configurations may be used to produce similar results. For example, the agitator need not share a common drive shaft with the impeller of the pump, but may be separately driven from an oppositely-directed shaft. Also, the pump intake could be inverted to be upwardly directed with the impeller positioned correspondingly. The disclosed embodiment, however, represents the simplest and best mode known to the inventor at the present time.

In operation, ice pieces 56 from a selected source enter the housing 28 through the delivery chute 28. Water enters the housing 28 through a water inlet 58 The water level within the housing 28 can be maintained manually or through any of a variety of well-known level-sensing switch/valve combinations such a float switch operably connected to an electric valve in the water supply inlet 58. Preferably, the water level is maintained between a minimum level of approximately midway on the impeller housing 42 to slightly above the impeller housing 42, as shown in FIG. 2. In any event, the level must be maintained higher than the pump inlet 44. It makes no difference to the operation of this apparatus whether the water used is fresh water or seawater, if available.

Due to the difference in specific gravity between water in a frozen state and water in a liquid state, the ice pieces 56 tend to float in an upper layer 60 within the housing 28. Below this upper layer 60 of ice pieces and water is a lower layer 62 which comprises essentially water without a significant volume of ice pieces. The volume of ice pieces 56 within the housing 28 should be maintained such that the interface between these two layers 60, 62 is slightly below the pump intake 44. In this manner, a combination of ice pieces and water will be drawn into the pump intake 44.

As previously described, an agitator member 54 is positioned outwardly of and below the pump inlet 44 between the inlet 44 and the bottom 30 of the housing 28. The impeller member 54 may be formed in any of a variety of shapes as required to perform the desired functions. One function of the impeller member 54 is to impart an overall swirling motion to the ice pieces 56 and water within the housing 28, as indicated by motion arrows 66 in FIG. 3. As the raw ice pieces 56 enter the housing 28, they will typically be of irregular shape and have sharp corners or edges. The swirling motion within the container causes ice pieces 56 to cOllide with each other and the sidewalls 32 of the housing 28. Although this swirling motion is at a substantially slower rate than the rotation of the agitator member 54, sufficient centrifugal force is created to cause smaller, less dense ice pieces to migrate toward the center of the housing 28 as larger, raw pieces of ice 56 displace them along the periphery of the housing 28. Also, because the agitator member 54 is substantially centrally disposed within the housing 28, the swirling rate around the pumping apparatus 34 at the center of the housing 28 is greater than that at the periphery of the housing 28. In this manner, the ice pieces which are drawn into the pump inlet 44, near the center of the housing 28, are those which have become smallest and smoothest or most highly abraded (sharp edges worn away).

To further assist in facilitating the swirling motion within the housing 28, the ice delivery chute 26 and water inlet 58 may be selected at an angle so that the ice pieces 56 and water entering the housing 28 move in a direction which continues their momentum.

Another function of the agitator member 54 is to actively agitate or churn the ice pieces and water in the housing 28, especially in the vicinity adjacent the pump inlet 44. According to one embodiment, as shown in FIG. 2, the impeller member 54 may include vanes angled to drive ice particles and water downwardly and outwardly, as well as to impart the circular, swirling motion described above. This action further facilitates the drawing of ice particles and water from the upper region 60 within the container.

Figure 4:
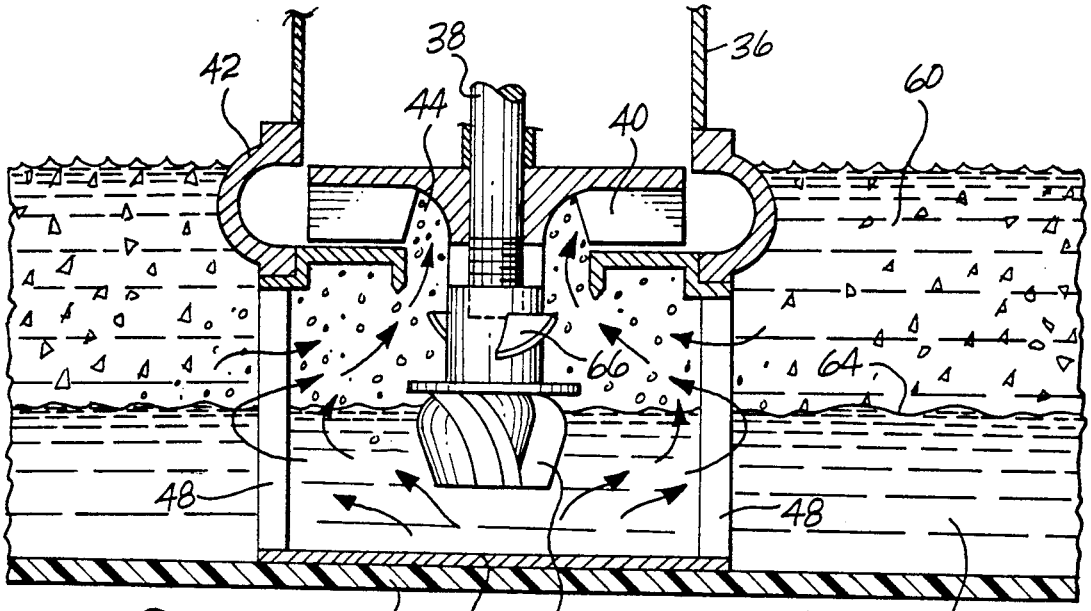
FIG. 4 is a cross-sectional view of the pumping apparatus showing a first alternative agitation member.
Figure 5:
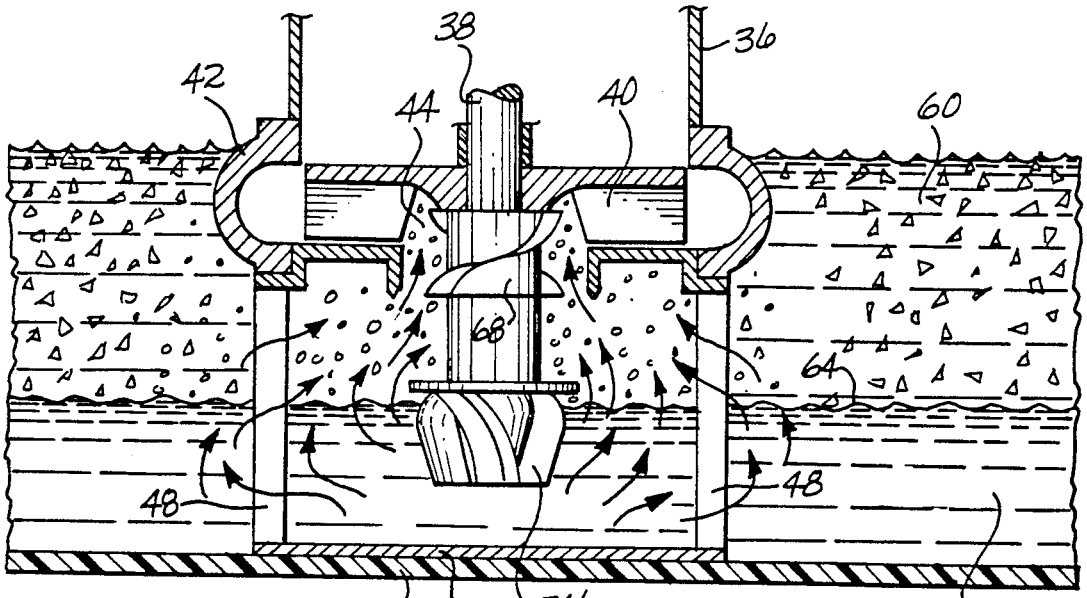
FIG. 5 is a cross-sectional view of the pumping apparatus showing a second alternative agitation member.

Referring now also to FIGS. 4 and 5, therein are shown alternate agitator members 54' in combination with secondary agitator members 66, 68. The secondary agitator member 66 shown in FIG. 4 is spaced outwardly and downwardly from the pump inlet 44, immediately adjacent the main impeller 54', This secondary impeller assists in drawing ice particles along with the water from the upper layer 60 of the water bath within the housing 28. The agitator 66 may also be used to further chop ice particles prior to their entry into the pump inlet 44. The secondary agitator 68 shown in FIG. 5 is positioned within or adjacent to the pump inlet 44 and is axially spaced from the main agitator member 54'. This secondary agitator member 68 is designed to increase the draw of ice particles and water into the inlet 44 as well as to act as an ice particle size limiter. Either of the illustrated secondary impeller members 66, 68 are especially useful When the raw ice 56 delivered into the housing 28 is generated as relatively coarse tube ice or cubes.

Upon discharge from the pump 34 through the delivery outlet 50, the ice particles and water in the form of slush ice are carried through a delivery hose 52 or pipe to the desired point of use. Typically the delivered slush ice contains approximately 50% ice particles and 50% water. This ratio has been found to be particularly effective for use in the fish packing industry. Other ratios may be selected as desired to meet specific needs.

Likewise, the slush ice making and pumping apparatus 12 may be selected to have any desired capacity. For example, a useful and efficient combination has been found to include a housing 28 approximately 48 inches in diameter and 30 inches high to hold approximately 210 gallons. The housing may be made from any suitable material, however, low-density polyethylene has been found to be suitably strong and lightweight. A 7.5 horsepower pump operating at 1800 rpm can pump 150 gallons of water and carry 300 pounds of ice per minute. The slush ice can be pumped through up to 400 feet of 3-inch diameter delivery hose 52 or pipe with a total head (vertical height) of 39 feet. Depending on delivery requirements, equipment of various capacities may be selected in combination to meet such requirements.

Figure 6:
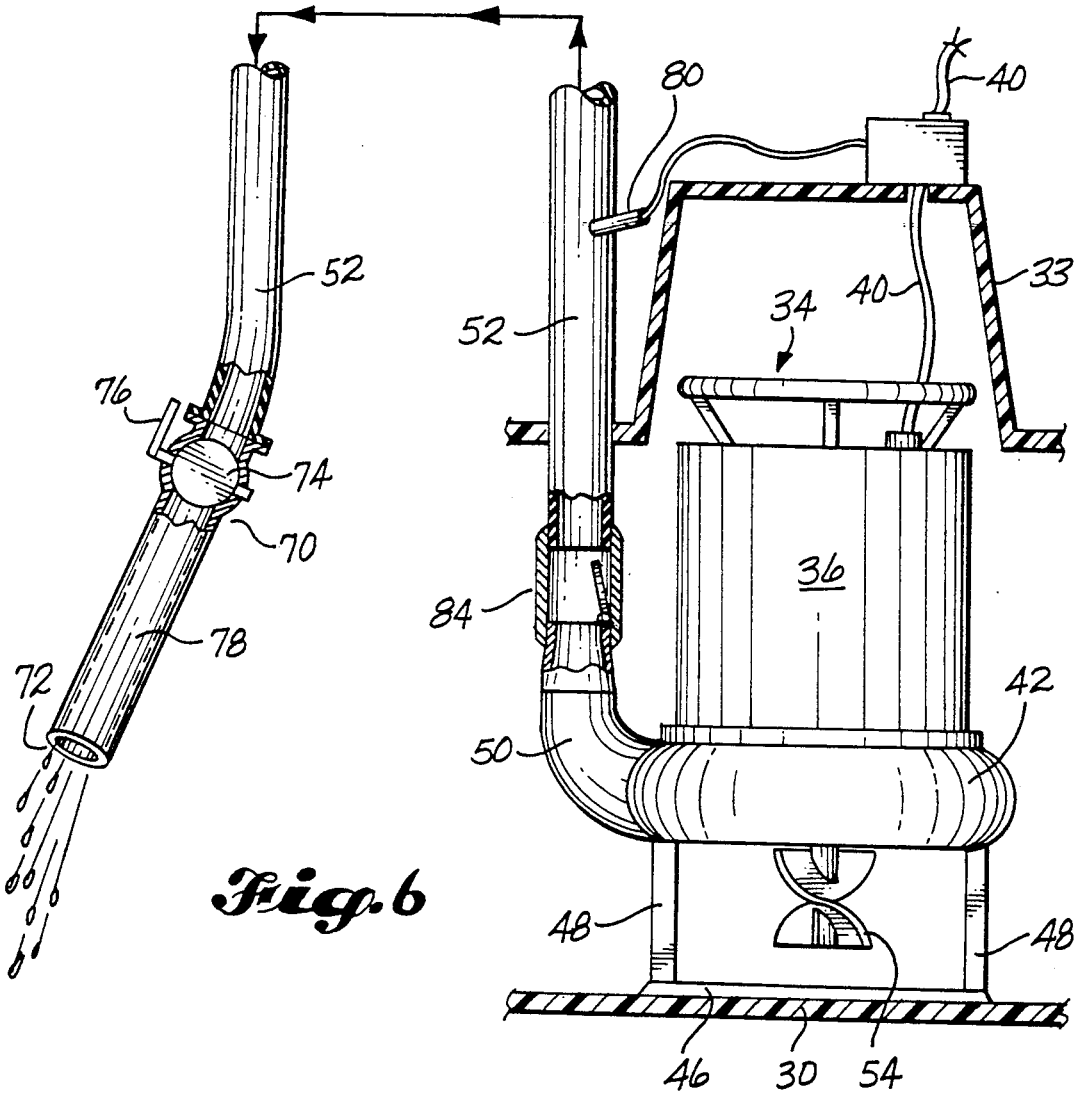
FIG. 6 is a schematic representation of an automatic, back-pressure pump shut off switch mechanism.

Referring now to FIG. 6, according to another feature of the invention, a shut-off valve 70 may be included adjacent the delivery end 72 of the hose 52. The valve 70 may be of any suitable style which allows free flow when in the open position, such as a ball-type valve or damper-type valve having a vane 74 manually controlled by a handle 76. A relatively stiff wand or nozzle 78 may be included at the delivery end 72 for directing the flow of slush ice. When the valve 70 is closed and the pump 34 continues to run, pressure will continue to build in the hose 52 behind the valve 70. If maintained for extended periods of time, this pressure could cause damage to the hose 52 and/or pump 34. Because the delivery end 72 of the hose 52 may be a substantial distance away from the pump 34, it is not practical for the hose handler to return to the pump 34 or to communicate a signal back to the slush making apparatus 12 operator.

Having a remote shut-off switch at the delivery end 72 of the hose 52 would require the separate running of electrical conductors along with the hose 52, creating a potentially hazardous situation due to electrical shock or entanglement with slack cable. The present invention provides a pressure-sensing switch 80 adjacent the pump end of the delivery hose 52. In combination with a mechanical or electronic relay means 82, the pressure-sensing switch 80 can disconnect power (40) from the pump 34 when pressure inside the delivery line 52 reaches a predetermined level. It has been found that 50 psi is a suitable pressure level at which the pump may be shut off. In order to prevent back flow of slush ice within the delivery hose 52 when the pump 34 is turned off, a check valve means 84 is positioned in the line at a point between the pressure-sensing switch 80 and pump 34. The check valve means may be of any well-known type, such as a simple or flapper or damper. The slush ice held within the delivery hose 52 between the shut-off valve 70 and check valve 84 will be maintained under pressure. While maintained under pressure, the slush ice particles are less likely to bridge or clump together, potentially causing blockage in the hose 52. Should the pressure within the hose drop below a predetermined level, the pressure-sensing switch 80 would signal the relay 82 to reactivate the pump 34 until suitable pressure is once again achieved. When the shut-off valve 70 is re-opened by the operator, pressure within the delivery hose 52 will drop, also causing the pump 34 to be reactivated.

Figure 7:
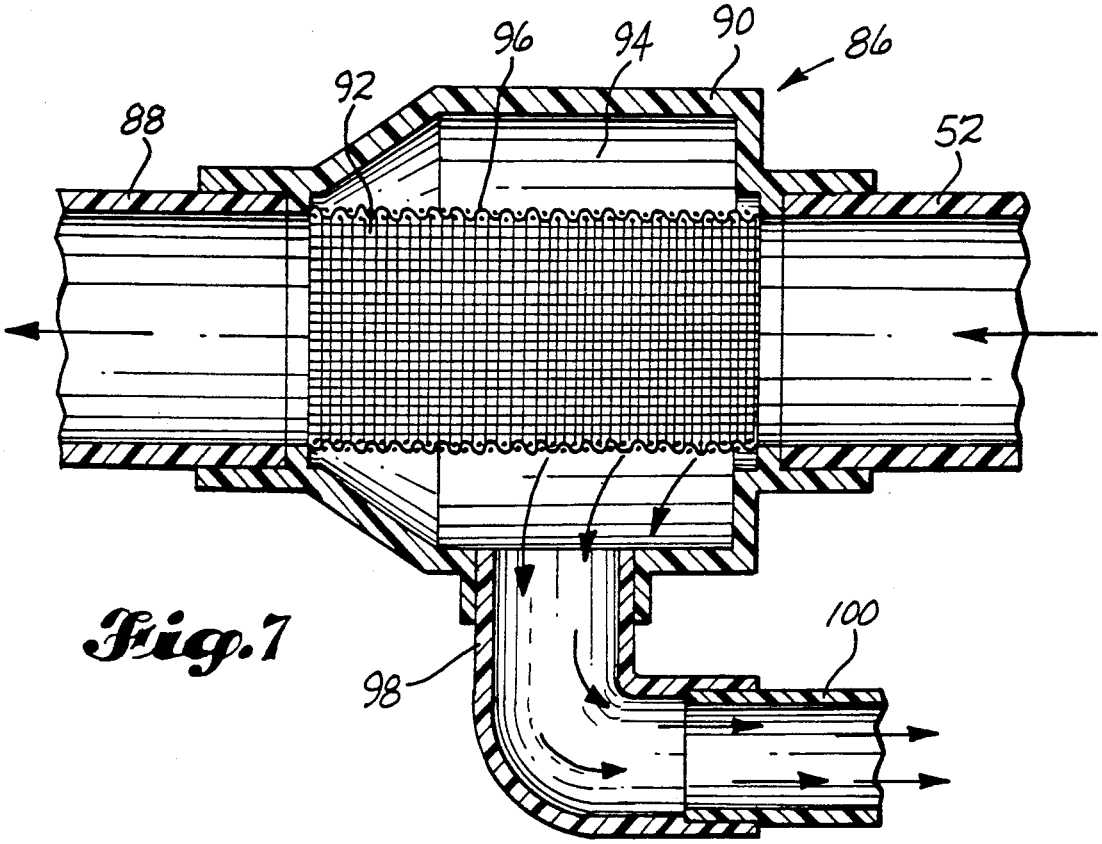
FIG. 7 is a cross-sectional view of the preferred embodiment of a water-removing attachment device.

In some situations, it may be desirable to have smooth ice particles delivered without a significant volume of water being included therewith. Referring now to Figs. 1 and 7, according to another aspect of the invention, a water separating or removing cuff 86 may be included adjacent the delivery nozzle 88 of the delivery hose 52. The water-removing cuff 86 includes an outer housing 90 with fittings at opposite ends to operably attach to the delivery hose 52 and delivery nozzle 88. Inner and outer chambers 92, 94 are defined within the housing 90 by a barrier screen 96. In preferred form, the barrier screen 96 is tubular in shape having an inner diameter which conforms with that of the delivery hose 52 so as not to restrict flow therethrough. The screen is preferably made from stainless steel or other noncorrosive material and includes openings or perforations sized to readily permit the flow of water therethrough but to exclude ice particles of predetermined size. The water-removing cuff 86 includes a water-return outlet 98 to which suction is applied by a pump (not shown). Water is drawn from the slush ice mixture as it enters the inner chamber 92 from the delivery hose 52. Remaining ice particles are then forced onward by additional slush ice being pumped behind it through the delivery hose 52. A circulating pump may be used to draw water from the water-return outlet 98 through a return line 100. If desired, the water may be recirculated into the main housing 28 through a separate line 102 or may be introduced into the main water supply inlet 58. Whether or not to recirculate the drawn-off water will depend upon the availability and cost of water at the particular site.

According to another aspect of the invention, the water used to make and carry the slush ice in the housing 28 may be ozonated. Ozone ($O_3$) is a form of oxygen used for sterilizing water or food products Commercial ozone generators, or ozonizers, are commonly available. These devices convert atmospheric oxygen into ozone by passing an electric spark through an air chamber and then separating the generated ozone from other gas components. Referring to FIGS. 1 and 2, a small delivery tube 104 extends between an ozone generator (not shown) and a point below the normal water level within the main housing 28. An ozone generator which produces 16 grams of ozone per hour is sufficient for use with a slush making/pumping apparatus having the approximate capacities of the above-described example. Regulations in fish and poultry industries often require that the food products be treated with a bacteria-killing agent, such as ozone or chlorine. Using ozone eliminates the concern of environmental contamination when slush ice is drained away onto the ground or into natural bodies of water. Ozone generators are extremely compact and efficient to operate on site and eliminating the need for transporting bulky and potentially dangerous canisters of compressed chlorine gas.

The present invention also includes a method of making and delivery slush ice. The above-described apparatus 12 may be used with this method. The best mode of carrying out this method includes the following steps. A housing 28 having substantially cylindrical sidewalls 32 and a bottom 30 is provided. A pump 34 having a delivery outlet 50 and an inlet opening 44 that is substantially centered axially within the housing 28 and spaced a predetermined distance from the bottom 30 of the container 28 is provided. Raw ice pieces 56 are delivered into the housing through an angled ice delivery chute 26. Water is delivered into the housing 28 through an inlet 58 at a rate which maintains the level of water and ice pieces higher than the pump inlet 44. The ice pieces and water within the housing are swirled by a rotating agitator member 54 so that the ice pieces and water are agitated against one another and against the sidewalls 32 of the housing 28 and are admixed together by the swirling motion. The agitated and admixed ice and water mixture is drawn into the pump inlet 44 and delivered as slush ice through the pump outlet 50.

According to the preferred method, the agitator member 54 drives the ice and water mixture in a swirling motion at a rate which will cause the smaller, smoother ice pieces to migrate inwardly toward the pump opening 44 as larger, unprocessed ice pieces 56 displace them along the periphery of the housing 28. The ice pieces tend to float in an upper layer 60 of the water and are drawn off as slush ice without the need to drive ice pieces downwardly to a bottom pump intake. The agitator 53 may be co-axially mounted with the impeller 40 of a centrifugal pump. According to an alternate method, a second agitator member 66, 68 may be positioned between the main agitator 54, 54', and the pump inlet 44 to further agitate and chop ice pieces prior to their entry into the pump, or to limit the size of ice particles entering the pump.

The method may also include the step of ozonating the water in the housing 28 as it is agitated and admixed with the ice pieces prior to pumping and delivering it as slush ice. As previously described, ozonation of the slush ice will provide the necessary sterilization effect on the water and food products being packed in the slush ice. This method may be practiced equally well using either fresh water or seawater.

If desired, a portion or substantially all of the water may be separated and removed from the slush ice mixture upon delivery. The above-described water-removing cuff 86 apparatus represents the presently-preferred method for carrying out the water-removal step. The removed water may be either discarded or recirculated into the main housing 28.

In use, the slush ice may be used to pack fish, poultry or other food products by delivering slush ice 16, preferably having a composition of 50% ice and 50% water, into a container 14 for receiving the items to be chilled. It has been found that by first filling such a container 14 approximately half full of slush ice 16, and then dropping in the items to be packed and chilled within the container 14, slush ice will be carried around and against all surfaces of the products, and in the case of fish or dressed poultry, into mouth, gill and body cavities. The slush ice produced according to the above-described method is lightweight and free of sharp or jagged edges which can damage delicate produce.

It has been found that after packing or loading produce in this manner, it may be desirable to drain away the majority of water from the slush ice in the container 14 through a bottom drain outlet 106. This will leave the items packed in smooth ice which is layered throughout the entire container 14 and packed against each item to assure maximum chilling. The remaining ice resists caking or clumping and does not retain a significant amount of water. When the water has been ozonated, as described above, draining away the water will carry away with undesired dirt, contaminates, and slime, which is commonly associated with fresh fish. The bacteriocidal and de-sliming effect on packed fish makes the fish cleaner and safer to handle and will allow them to be packed in storage containers for considerable periods of time without spoilage. After the water and slime have been drained away, additional ice may be added to the top of the container 14 prior to closing the container 14 with a lid for storage or shipment.

Figure 8:
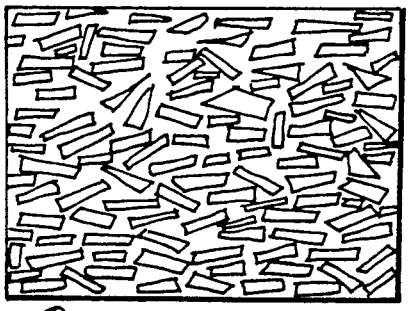
FIG. 8 is a representation of the relative size and shape of unprocessed flake ice.
Figure 9:
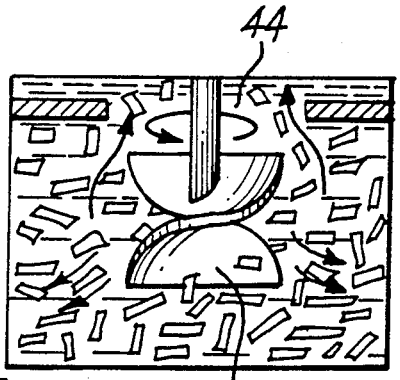
FIG. 9 is a representation of flake ice suspended in water and undergoing agitation.
Figure 10:
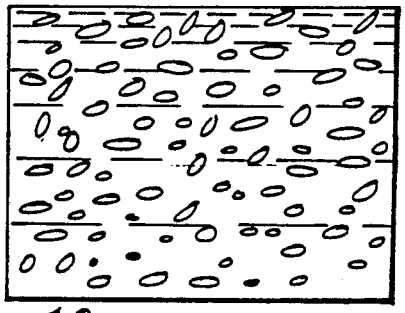
FIG. 10 is a representation of the relative size and shape of slush ice particles suspended in water.
Figure 11:
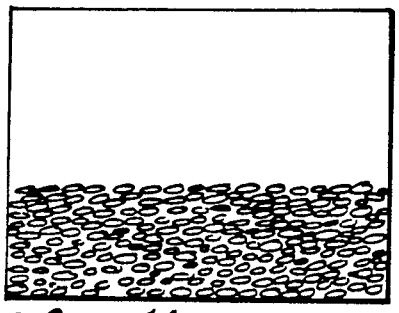
FIG. 11 is a representation of the relative size, shape and volume of slush ice particles having substantially all of the carrying water removed therefrom.

Referring now to FIGS. 8 and 10, therein are shown relative comparisons of the size and shape of unprocessed flake ice pieces (FIG. 8) and slush ice (FIG. 10) comprising approximately 50% ice particles and 50% water. FIG. 11 illustrates the relative volume of small, smooth ice particles remaining after the water has been drained from slush ice produced by the above-described apparatus and according to the above-described method. FIG. 9 illustrates the agitation effect of the agitator member 54 as it churns and swirls the ice pieces and water and causes slush ice to be drawn into the pump inlet 44 from the uppermost level in the housing 28.

It is to be understood that the above-described and illustrated embodiments and methods are illustrative only. Many alterations in the apparatus may be made in order to adapt the present invention to a particular situation or purpose. Therefore, patent protection is not to be limited by these examples, but rather by the following claim or claims interpreted according to accepted doctrines of claim interpretation, including the doctrine of equivalents.

What is claimed is:

1. An apparatus for producing and delivering slush ice, comprising:

a main housing having a floor and substantially cylindrical sidewalls, said housing including a water inlet and an ice inlet;

a pump having a delivery outlet and an inlet substantially centered axially within said housing and spaced a predetermined distance from said floor;

a delivery conduit having a first end operably connected to said delivery outlet and a second end remote therefrom;

a rotating agitator member having an axis of rotation substantially centered co-axially within said housing such that said agitator swirls ice and water in said housing substantially around said pump inlet, said ice floating in an upper layer substantially above a lower layer of water which is substantially devoid of ice; and said pump drawing ice and water from said upper layer through said inlet and delivering a mixture of ice and water in the form of slush ice through said delivery outlet.

2. The apparatus of claim 1, wherein said pump includes a centrifugal impeller.

3. The apparatus of claim 2, wherein said rotating agitator member and said centrifugal impeller have substantially co-axial axes of rotation.

4. The apparatus of claim 3, further comprising a second rotating agitator member positioned between the first agitator member and said pump inlet.

5. The apparatus according to claim 3, wherein said rotating agitator member and said centrifugal impeller are disposed on a common drive shaft.

6. The apparatus of claim 5, further comprising a second rotating agitator member positioned between the first agitator member and said pump inlet.

7. The apparatus of claim 6, wherein said second agitator member is positioned to cooperate with said inlet to limit the size of ice pieces drawn into said inlet.

8. The apparatus of claim 1, further comprising a means for separating water from said slush ice adjacent said second end of said delivery conduit.

9. The apparatus according to claim 8, wherein said water separating means includes a further means for returning separated water into said main housing.

10. The apparatus according to claim 8, wherein said water separating means includes an outer chamber and an inner chamber with an ice-excluding water-permeable wall between said chambers, said inner chamber having input and output openings, and said slush ice being delivered into said input opening, said water being drawn through said wall, and slush ice moving outwardly through said output opening.

11. The apparatus according to claim 10, wherein said water separating means includes a further means for returning separated water into said main housing.

12. The apparatus according to claim 1, wherein said water inlet and said ice inlet are provided at an angle such that entering water and ice promote the swirl of said ice and water in said housing.

13. The apparatus according to claim 1, wherein water in said housing is ozonated.

14. The apparatus according to claim 1, including a valve operably positioned adjacent said second end of said delivery conduit and a pressure-sensing switch operably connected to turn off said pump when pressure within said delivery conduit reaches a predetermined pressure.

15. The apparatus according to claim 14, including a check valve operably positioned between said pressure sensing-switch and said delivery outlet.

16. Method of producing and delivering slush ice, comprising the steps of:

providing a housing having a floor and substantially cylindrical sidewalls;

providing a pump having a delivery outlet and an inlet substantially centered axially within said housing and spaced a predetermined distance from said floor;

delivering ice pieces into said housing;

delivering water into said housing at a rate which maintains the level of said water and said ice pieces higher than said pump inlet;

swirling said ice pieces and said water within said housing such that said ice pieces and said water are agitated and admixed by said swirling, said ice floating in an upper layer substantially above a lower layer of water which is substantially devoid of ice;

drawing said agitated and admixed ice and water mixture into said pump inlet from said upper layer and delivering slush ice through said pump outlet.

17. The method according to claim 16, wherein said pump includes a centrifugal impeller.

18. The method according to claim 17, wherein said rotating agitator member and said centrifugal impeller have substantially co-axial axes of rotation.

19. The method according to claim 18, further comprising a second rotating agitator member positioned between the first agitator member and said pump inlet.

20. The method according to claim 16, further comprising a second rotating agitator member positioned between the first agitator member and said pump inlet.

21. The method according to claim 16, further comprising the step of adding ozone to the water in said housing.

22. The method according to claim 16, wherein said water inlet and said ice inlet are provided at an angle such that entering water and ice promote the swirl of said ice and water in said housing.

23. The method according to claim 16, further comprising the step of removing water from said slush ice after delivery from said pump outlet.

24. The method according to claim 23, wherein said removed water is returned into said housing.

25. Slush ice produced according to the method of claim 16.

26. Slush ice produced according to the method of claim 21.

27. Slush ice produced according to the method of claim 23.

28. Slush ice produced according to the method of claim 20.

* * * * *